US011268757B2

(12) United States Patent
McCool et al.

(10) Patent No.: US 11,268,757 B2
(45) Date of Patent: Mar. 8, 2022

(54) METHODS FOR PROVIDING REFRIGERATION IN NATURAL GAS LIQUIDS RECOVERY PLANTS

(71) Applicant: Linde Engineering North America, Inc., Blue Bell, PA (US)

(72) Inventors: Grant McCool, Tulsa, OK (US); Thomas Walter, Munich (DE); Arturo Puigbo, Tulsa, OK (US)

(73) Assignee: Linde Engineering North America, Inc., Blue Bell, PA (US)

( * ) Notice: Subject to any disclaimer, the term of this patent is extended or adjusted under 35 U.S.C. 154(b) by 95 days.

(21) Appl. No.: 16/644,990

(22) PCT Filed: Sep. 5, 2018

(86) PCT No.: PCT/US2018/049535
§ 371 (c)(1),
(2) Date: Mar. 6, 2020

(87) PCT Pub. No.: WO2019/050940
PCT Pub. Date: Mar. 14, 2019

(65) Prior Publication Data

US 2020/0284507 A1 Sep. 10, 2020

Related U.S. Application Data

(63) Continuation of application No. 15/952,492, filed on Apr. 13, 2018, now abandoned.
(Continued)

(51) Int. Cl.
*F25J 3/02* (2006.01)

(52) U.S. Cl.
CPC ..... *F25J 3/0295* (2013.01); *F25J 3/0209* (2013.01); *F25J 3/0233* (2013.01); *F25J 3/0238* (2013.01);
(Continued)

(58) Field of Classification Search
CPC ..... F25J 2240/02; F25J 2240/40
See application file for complete search history.

(56) References Cited

U.S. PATENT DOCUMENTS 3,397,138 A * 8/1968 Bacon ..... F25J 3/0233 208/340
4,070,172 A * 1/1978 Smith ..... B01D 3/4288 203/2

(Continued)

FOREIGN PATENT DOCUMENTS

WO 2012-075266 A2 6/2012

OTHER PUBLICATIONS

International Search Report of the International Searching Authority for PCT/US2018/049535 dated Dec. 20, 2018.

*Primary Examiner* — Ljiljana V. Ciric
(74) *Attorney, Agent, or Firm* — Millen, White, Zelano & Branigan, P.C.; Brion P. Heaney

(57) ABSTRACT

A process and plant for natural gas liquids (NGL) recovery includes a main heat exchanger, a cold gas/liquid separator, a separation or distillation column, and an overhead gas heat exchanger. A pressurized residue gas generated from an overhead gas stream removed the top of the separation or distillation column is expanded and used as a cooling medium in the overhead gas heat exchanger and the main heat exchanger. The expanded residue gas, used as a cooling medium, is then compressed up to a pressure to be combined with the overhead stream from the separation or distillation column.

16 Claims, 5 Drawing Sheets

Related U.S. Application Data

(60) Provisional application No. 62/554,633, filed on Sep. 6, 2017.

(52) U.S. Cl.
CPC ..... *F25J 3/0242* (2013.01); *F25J 2200/02* (2013.01); *F25J 2200/30* (2013.01); *F25J 2200/72* (2013.01); *F25J 2200/76* (2013.01); *F25J 2205/04* (2013.01); *F25J 2210/60* (2013.01); *F25J 2215/04* (2013.01); *F25J 2215/60* (2013.01); *F25J 2215/62* (2013.01); *F25J 2215/64* (2013.01); *F25J 2230/30* (2013.01); *F25J 2230/60* (2013.01); *F25J 2240/02* (2013.01); *F25J 2240/40* (2013.01); *F25J 2270/04* (2013.01); *F25J 2270/88* (2013.01); *F25J 2290/40* (2013.01)

(56) References Cited

U.S. PATENT DOCUMENTS 4,164,451 A * 8/1979 Funk ..... F25J 3/0209 203/2
4,164,452 A * 8/1979 Funk ..... F25J 3/0209 203/2
4,195,979 A * 4/1980 Martin ..... F25J 1/0022 62/613
4,474,591 A * 10/1984 Arand ..... F25J 3/0233 62/630
4,695,303 A * 9/1987 Montgomery, IV ... F25J 3/0233 62/622
4,746,342 A * 5/1988 DeLong ..... F25J 3/0209 62/622
5,568,737 A 10/1996 Campbell et al.
5,600,969 A * 2/1997 Low ..... F25J 1/0022 62/622
5,673,571 A * 10/1997 Manley ..... C10G 5/06 62/630
5,678,424 A * 10/1997 Nazar ..... C07C 7/04 62/630
5,884,504 A * 3/1999 Nazar ..... F25J 3/0242 62/630
5,953,935 A * 9/1999 Sorensen ..... F25J 3/0238 62/621
6,125,653 A * 10/2000 Shu ..... F25J 1/0202 62/48.2
6,244,070 B1 * 6/2001 Lee ..... F25J 3/0209 62/620
6,354,105 B1 * 3/2002 Lee ..... F25J 3/0209 62/619
6,401,486 B1 * 6/2002 Lee ..... F25J 1/0216 62/630
6,564,580 B2 * 5/2003 Bowen ..... F25J 3/0238 62/623
6,662,589 B1 * 12/2003 Roberts ..... F25J 1/005 62/425
7,051,552 B2 * 5/2006 Mak ..... B01D 53/002 62/621
7,219,513 B1 * 5/2007 Mostafa ..... F25J 3/0209 62/620
7,257,966 B2 * 8/2007 Lee ..... F25J 3/0209 62/620
7,713,497 B2 * 5/2010 Mak ..... F25J 3/0238 422/187
8,156,758 B2 * 4/2012 Denton ..... F25J 3/0214 62/620
8,209,996 B2 * 7/2012 Mak ..... F25J 3/0233 62/628
8,209,997 B2 * 7/2012 Malsam ..... F25J 3/0242 62/630
8,413,463 B2 * 4/2013 Malsam ..... F25J 3/0238 62/630
9,103,585 B2 * 8/2015 Mak ..... C10G 5/06
9,175,905 B2 * 11/2015 Patel ..... F25J 3/064
9,291,387 B2 * 3/2016 Malsam ..... F25J 3/0209
9,316,433 B2 * 4/2016 Mak ..... F25J 3/0233
9,410,737 B2 * 8/2016 Mak ..... F25J 3/0238
9,423,175 B2 * 8/2016 Mak ..... F25J 3/0242
9,777,960 B2 10/2017 Currence et al.
9,803,917 B2 * 10/2017 Burmberger ..... F25J 1/0072
9,841,231 B2 * 12/2017 Qualls ..... F25J 3/0209
2007/0157663 A1 7/2007 Mak et al.
2008/0271480 A1 11/2008 Mak
2009/0293537 A1 * 12/2009 Ameringer ..... F25J 3/0238 62/620
2010/0011810 A1 * 1/2010 Mak ..... F25J 3/0238 62/630
2010/0050688 A1 * 3/2010 Ameringer ..... F25J 3/0233 62/620
2010/0206003 A1 * 8/2010 Mak ..... F25J 3/0209 62/630
2012/0137726 A1 6/2012 Currence et al.
2012/0304690 A1 * 12/2012 Malsam ..... F25J 3/0238 62/620
2013/0104598 A1 * 5/2013 Ameringer ..... F25J 3/0233 62/620
2013/0219957 A1 * 8/2013 Malsam ..... F25J 3/0214 62/620
2014/0060114 A1 * 3/2014 Mak ..... F25J 3/0242 62/630
2014/0075987 A1 * 3/2014 Mak ..... F25J 3/0233 62/630
2014/0096563 A2 * 4/2014 Martinez ..... F25J 3/0233 62/620
2014/0182331 A1 * 7/2014 Burmberger ..... F25J 1/021 62/630
2014/0260420 A1 * 9/2014 Mak ..... F25J 3/0238 62/620
2014/0260421 A1 * 9/2014 Lee ..... F25J 3/0233 62/636
2015/0013377 A1 * 1/2015 Oelfke ..... F25J 1/00 62/602
2016/0054055 A1 * 2/2016 Patel ..... C10G 70/043 62/621
2016/0231052 A1 * 8/2016 Mak ..... F25J 3/0238
2017/0191753 A1 * 7/2017 Mak ..... F25J 3/0242
2017/0276427 A1 * 9/2017 Lee ..... F25J 3/0242
2017/0336137 A1 * 11/2017 Mak ..... F25J 1/0022
2017/0336138 A1 * 11/2017 Burmberger ..... F25J 1/0045
2018/0058752 A1 * 3/2018 Johnston ..... F25J 3/0238
2018/0231306 A1 * 8/2018 Butts ..... F25J 3/0295
2018/0266756 A1 * 9/2018 Mak ..... C10G 5/06
2018/0266760 A1 * 9/2018 Mak ..... F25J 3/0238
2018/0306498 A1 * 10/2018 Rovers ..... F25J 3/0247
2018/0320960 A1 * 11/2018 Terrien ..... F25J 3/0209
2019/0049176 A1 * 2/2019 Mccool ..... F25J 3/0209
2019/0154333 A1 * 5/2019 Mak ..... F25J 3/0228
2019/0170435 A1 * 6/2019 Anguiano ..... F25J 3/0233
2019/0242645 A1 * 8/2019 Mak ..... F25J 1/0052
2020/0072547 A1 * 3/2020 Butts ..... F25J 3/0209
2020/0284507 A1 * 9/2020 Mccool ..... F25J 3/0233

* cited by examiner

METHODS FOR PROVIDING REFRIGERATION IN NATURAL GAS LIQUIDS RECOVERY PLANTS

This applicant claims the benefit under 35 U.S.C. 119(e) of U.S. provisional application Ser. No. 62/554,633, filed Sep. 6, 2017.

BACKGROUND OF THE INVENTION

Natural gas is an important commodity throughout the world, as both an energy source and a source of raw materials. Worldwide natural gas consumption is projected to increase from 124 trillion cubic feet in 2015 to 177 trillion cubic feet in 2040 [U.S Energy Information Administration, International Energy Outlook 2017 (IEO2017)].

Natural gas is important not only as a source of energy but also as a source of feedstock for petrochemical manufacture. In general, natural gas is recovered from onshore and offshore oil and gas production wells. The major component of natural gas is typically methane. But, natural gas also contains amounts of other hydrocarbons such as ethane, propane, butanes, pentanes and heavier components. In addition to the hydrocarbon components, natural gas can also contain small amounts of water, hydrogen, nitrogen, helium, argon, hydrogen sulfide, carbon dioxide, and/or mercaptans. For example, a typical natural gas may contain about 70 to 90 vol. % methane, about 5 to 10 vol. % ethane, and the balance being propane, butanes, pentanes, heavier hydrocarbons, and trace amounts of various other gases (e.g., nitrogen, carbon dioxide, and hydrogen sulfide).

While natural gas is typically transported in high pressure transmission pipelines, natural gas is also commonly transported in liquefied form. In this case, the natural gas is first cryogenically liquefied and then the liquefied gas is transported via cargo carriers (e.g., trucks, trains, ships). However, liquefaction of natural gas can be problematic since some components like the heavier hydrocarbons can form solids at cryogenic temperatures causing problems in equipment operation.

In natural gas processing the feedstream is typically treated to remove impurities such as carbon dioxide and sulfur compounds. But, in addition, the natural gas can be treated to reduce the level of heavier hydrocarbons to thereby avoid solidification and plugging of cryogenic heat exchange equipment. Further, the content of lighter hydrocarbons such as C2, C3, and C4 may also be reduced during natural gas processing in order to meet commercial requirements for the natural gas. Moreover, these lighter hydrocarbons are valuable feedstock materials. C2 is an important feedstock for petrochemical manufacture, C3 and C4 can be sold as LPG (liquefied petroleum gas) fuels, and C5+ hydrocarbons can be used for gasoline blending. Natural gas liquids (NGL) recovery refers to the process of removing and collecting these lighter and heavier hydrocarbon products from natural gas.

Several known processes for liquefaction of natural gas and recovery of C2+ hydrocarbons (NGL recovery) involve cryogenic expansion using a turbo-expander. In the Gas Subcooled Process (GSP) developed in the late 1970's, the natural gas feed stream after being cooled in a main heat exchanger is separated in a gas/liquid separator into a gas fraction and a liquid fraction. The liquid fraction is expanded and sent to the demethanizer (or deethanizer) column. The gas fraction is split into two streams. The first stream is expanded in a turbo-expander and fed to the demethanizer (or deethanizer). The second stream is further cooled by heat exchange with the overhead gas stream from the demethanizer (or deethanizer) and then introduced into the demethanizer (or deethanizer) as a reflux stream. NGL product is removed from the bottom of the demethanizer (or deethanizer) and the overhead gas from the demethanizer (or deethanizer) is removed as a residue gas product stream containing predominantly methane. See, for example, Campbell et al. (U.S. Pat. No. 4,157,904).

A modification of the GSP process is the Recycle Split Vapor Process (RSV). In the RSV process a further reflux stream for the demethanizer (or deethanizer) column is generated from the residue gas product stream. After being cooled by heat exchange with a portion of the gas fraction from the gas/liquid separator and by heat exchange with the natural gas feed stream, the residue gas product stream is compressed. A portion of the compressed residue gas is cooled by heat exchange with the overhead gas stream from the demethanizer (or deethanizer) column, expanded and introduced into the demethanizer (or deethanizer) column as reflux. See, for example, Campbell et al. (U.S. Pat. No. 5,568,737).

Other processes for the recovery of natural gas liquids are known. For example, Buck (U.S. Pat. No. 4,617,039) describes a process wherein a natural gas feed stream is cooled, partially condensed, and then separated in a high-pressure separator. The liquid stream from the separator is warmed and fed into the bottom of a distillation (deethanizer) column. The vapor stream from the separator is expanded and introduced into a separator/absorber. Bottom liquid from the separator/absorber is used as liquid feed for the deethanizer column. The overhead stream from the deethanizer column is cooled and partially condensed by heat exchange with the vapor stream removed from the top of the separator/absorber. The partially condensed overhead stream from the deethanizer column is then introduced into the upper region of the separator/absorber. The vapor stream removed from the top of the separator/absorber can be further warmed by heat exchange and compressed to provide a residue gas which, upon further compression, can be reintroduced into a natural gas pipeline.

In such processes for the NGL recovery (e.g., recovery of ethane, ethylene, propane, propylene and heavier components), often there is a need for an external refrigeration system, such as a propane refrigeration unit, to achieve temperatures suitable for cryogenic separation. In such a process the main heat exchanger(s) is/are typically in fluid communication with the external refrigeration system.

There is a need for more efficient NGL recovery processes, particularly processes which do not rely on an external refrigeration system and which can provide reduced energy consumption.

SUMMARY OF THE INVENTION

The present invention provides for enhanced heat integration within a natural gas liquid (NGL) recovery plant to reduce the need for an external refrigeration system and thus reduce the number of pieces of equipment needed to operate the plant.

In a typical turbo-expander plant, a dry and treated (e.g., treated in an amine scrubbing unit for $CO_2$ and/or sulfur compounds removal, a molecular sieve unit or glycol unit for dehydration, and/or a mercury absorbent guard bed for mercury removal) feed natural gas is cooled down in one or more heat exchangers by indirect heat exchange with one or more cold process streams, often augmented with external refrigeration such as a propane refrigeration cycle. Such a typical NGL recovery plant is illustrated in FIG. 1.

The natural gas feed stream is cooled against process streams in a main heat exchanger(s) which is typically formed from one or more brazed aluminum heat exchangers. The feed may also be cooled by a refrigerant (e.g., flowing in a closed loop refrigeration cycle such as a closed loop propane refrigeration cycle) in one or more shell and tube heat exchangers (chillers). Alternatively, the refrigerant may pass through one or more passages of the main brazed aluminum heat exchanger(s). By this cooling, the feed stream is partially condensed and the partially condensed feed stream is then sent to an initial gas-liquid separation in a cold separator vessel. From the cold separator, the gas and liquid fractions are sent to a separation or distillation column for recovery of natural gas liquids (NGL) and a production of residue gas product stream containing predominantly methane.

In the plant and method according to the invention, an external refrigerant system such as a closed loop propane refrigeration cycle is not required (and preferably is not used) for cooling the natural gas feed stream. Instead, a portion of the residue gas stream produced by the plant is expanded and then used as a cooling medium in the main heat exchanger(s) and also used as a cooling medium in a heat exchanger for cooling reflux stream(s) used in the separation or distillation column.

Therefore, a process embodiment according to the invention for NGL recovery comprises:

introducing a natural gas feed stream into a main heat exchanger(s) wherein the feed stream is cooled and partially condensed, introducing the partially condensed feed stream into a cold gas/liquid separator wherein the partially condensed feed stream is separated into a liquid fraction and a gaseous fraction, introducing the liquid fraction into a separation or distillation column system, separating the gaseous fraction into a first portion and a second portion, cooling the first portion of the gaseous fraction in an overhead heat exchanger by indirect heat exchange with an overhead gaseous stream removed from the top of the separation or distillation column system, and introducing the cooled and partially condensed first portion of the gaseous fraction into the separation or distillation column system, expanding the second portion of the gaseous fraction and introducing the expanded second portion of the gaseous fraction into the separation or distillation column at, removing a C2+ or C3+ liquid product stream (NGL) from the bottom of the separation or distillation column system, removing the overhead gaseous stream from the top of the separation or distillation column system, the overhead gaseous stream being enriched with methane, using the overhead gaseous stream as a cooling medium in the overhead heat exchanger and in the main heat exchanger(s), compressing the overhead gaseous stream in a residue gas compression unit to obtain a pressurized residue gas stream, expanding a portion of the pressurized residue gas stream and using the expanded residue gas as a cooling medium in the overhead heat exchanger and in the main heat exchanger(s), and compressing the expanded residue gas used as a cooling medium to form a compressed residue gas stream and then combining the compressed residue gas stream with the overhead gaseous stream upstream of the residue gas compression unit.

In accordance with one aspect of the above process embodiment, the separation or distillation column system contains one column that acts as a demethanizer column or a deethanizer column. In accordance with another aspect of the above embodiment, the separation or distillation column system contains two columns that together act as a demethanizer column or a deethanizer column.

Another process embodiment according to the invention for NGL recovery comprises:

introducing a natural gas feed stream into a main heat exchanger(s) wherein the feed stream is cooled and partially condensed, introducing the partially condensed feed stream into a cold gas/liquid separator wherein the partially condensed feed stream is separated into a liquid fraction and a gaseous fraction, introducing the liquid fraction into a separation or distillation column, separating the gaseous fraction into a first portion and a second portion, cooling the first portion of the gaseous fraction in an overhead heat exchanger by indirect heat exchange with an overhead gaseous stream removed from the top of the separation or distillation column, and introducing the cooled and partially condensed first portion of the gaseous fraction into the separation or distillation column at a point above the introduction point of the liquid fraction into the separation or distillation column, expanding the second portion of the gaseous fraction and introducing the expanded second portion of the gaseous fraction into the separation or distillation column at a point above the introduction point of the liquid fraction into the separation or distillation column, removing a C2+ or C3+ liquid product stream (NGL) from the bottom of the separation or distillation column, removing the overhead gaseous stream from the top of the separation or distillation column, the overhead gaseous stream being enriched with methane, using the overhead gaseous stream as a cooling medium in the overhead heat exchanger and in the main heat exchanger(s), compressing the overhead gaseous stream in a residue gas compression unit to obtain a pressurized residue gas stream, expanding a portion of the pressurized residue gas stream and using the expanded residue gas as a cooling medium in the overhead heat exchanger and in the main heat exchanger(s), and compressing the expanded residue gas used as a cooling medium to form a compressed residue gas stream and then combining the compressed residue gas stream with the overhead gaseous stream upstream of the residue gas compression unit.

Additionally, an apparatus embodiment according to the invention for NGL recovery comprises:

a main heat exchanger(s) for cooling and partially condensing a natural gas feed stream, a separation or distillation column system for separating the natural gas feed stream into a C2+ or C3+ liquid product stream and an overhead gaseous stream enriched in methane, a cold gas/liquid separator wherein the partially condensed feed stream is separated into a liquid fraction and a gaseous fraction, a pipeline for removing the liquid fraction from the bottom of the cold gas/liquid separator and introducing the liquid fraction into the separation or distillation column system, means (e.g., pipe branching) for separating the gaseous fraction into a first portion and a second portion, an overhead heat exchanger for cooling the first portion of the gaseous fraction by indirect heat exchange with an overhead gaseous stream removed from the top of the separation or distillation column system, a pipeline for removing the cooled first portion of the gaseous fraction from the overhead heat exchanger and introducing the cooled first portion into the separation or distillation column system, means for expanding (e.g., a turbo-expander) the second portion of the gaseous fraction, a pipeline for removing the expanded first portion of the gaseous fraction from the means for expanding and introducing the expanded second portion of the gaseous fraction into the separation or distillation column system, a bottom outlet for removing the C2+ or C3+ liquid product stream (NGL) from the bottom of the separation or distillation column system, a top outlet for removing the overhead gaseous stream from the top of the separation or distillation column, a residue gas compression unit for compressing the overhead gaseous stream to obtain a pressurized residue gas stream, means for expanding (e.g., a turbo-expander) a portion of the pressurized residue gas stream to form an expanded residue gas stream, a pipeline for removing the expanded residue gas stream from the means for expanding and introducing the expanded residue gas stream into the overhead heat exchanger as a cooling medium, a pipeline for removing the expanded residue gas stream from the overhead heat exchanger and introducing the expanded residue gas stream into the main heat exchanger as a cooling medium, and means for compressing (e.g., a single or multistage compressor) the expanded residue gas to form a compressed residue gas stream and means for combining the compressed residue gas stream with the overhead gaseous stream upstream of the residue gas compression unit.

In accordance with one aspect of the above apparatus embodiment, the separation or distillation column system contains one column that acts as a demethanizer column or a deethanizer column. In accordance with another aspect of the above embodiment, the separation or distillation column system contains two columns that together act as a demethanizer column or a deethanizer column.

Another apparatus embodiment according to the invention for NGL recovery comprises:

a main heat exchanger(s) for cooling and partially condensing a natural gas feed stream, a separation or distillation column for separating the natural gas feed stream into a C2+ or C3+ liquid product stream and an overhead gaseous stream enriched in methane, a cold gas/liquid separator wherein the partially condensed feed stream is separated into a liquid fraction and a gaseous fraction, a pipeline for removing the liquid fraction from the bottom of the cold gas/liquid separator and introducing the liquid fraction into the separation or distillation column, means (e.g., pipe branching) for separating the gaseous fraction into a first portion and a second portion, an overhead heat exchanger for cooling the first portion of the gaseous fraction by indirect heat exchange with an overhead gaseous stream removed from the top of the separation or distillation column, a pipeline for removing the cooled first portion of the gaseous fraction from the overhead heat exchanger and introducing the cooled first portion into the separation or distillation column at a point above the introduction point of the liquid fraction into the separation or distillation column, means for expanding (e.g., a turbo-expander) the second portion of the gaseous fraction, a pipeline for removing the expanded first portion of the gaseous fraction from the means for expanding and introducing the expanded second portion of the gaseous fraction into the separation or distillation column at a point above the introduction point of the liquid fraction into the separation or distillation column, a bottom outlet for removing the C2+ or C3+ liquid product stream (NGL) from the bottom of the separation or distillation column, a top outlet for removing the overhead gaseous stream from the top of the separation or distillation column, a residue gas compression unit for compressing the overhead gaseous stream to obtain a pressurized residue gas stream, means for expanding (e.g., a turbo-expander) a portion of the pressurized residue gas stream to form an expanded residue gas stream, a pipeline for removing the expanded residue gas stream from the means for expanding and introducing the expanded residue gas stream into the overhead heat exchanger as a cooling medium, a pipeline for removing the expanded residue gas stream from the overhead heat exchanger and introducing the expanded residue gas stream into the main heat exchanger as a cooling medium, and means for compressing (e.g., a single or multistage compressor) the expanded residue gas to form a compressed residue gas stream and means for combining the compressed residue gas stream with the overhead gaseous stream upstream of the residue gas compression unit.

BRIEF DESCRIPTION OF THE DRAWINGS

The invention as well as further advantages, features and examples of the present invention are explained in more detail by the following descriptions of embodiments based on the Figures (in which like reference numerals are used to identify corresponding or analogous elements), wherein.

DETAILED DESCRIPTION OF THE INVENTION

Figure 1:
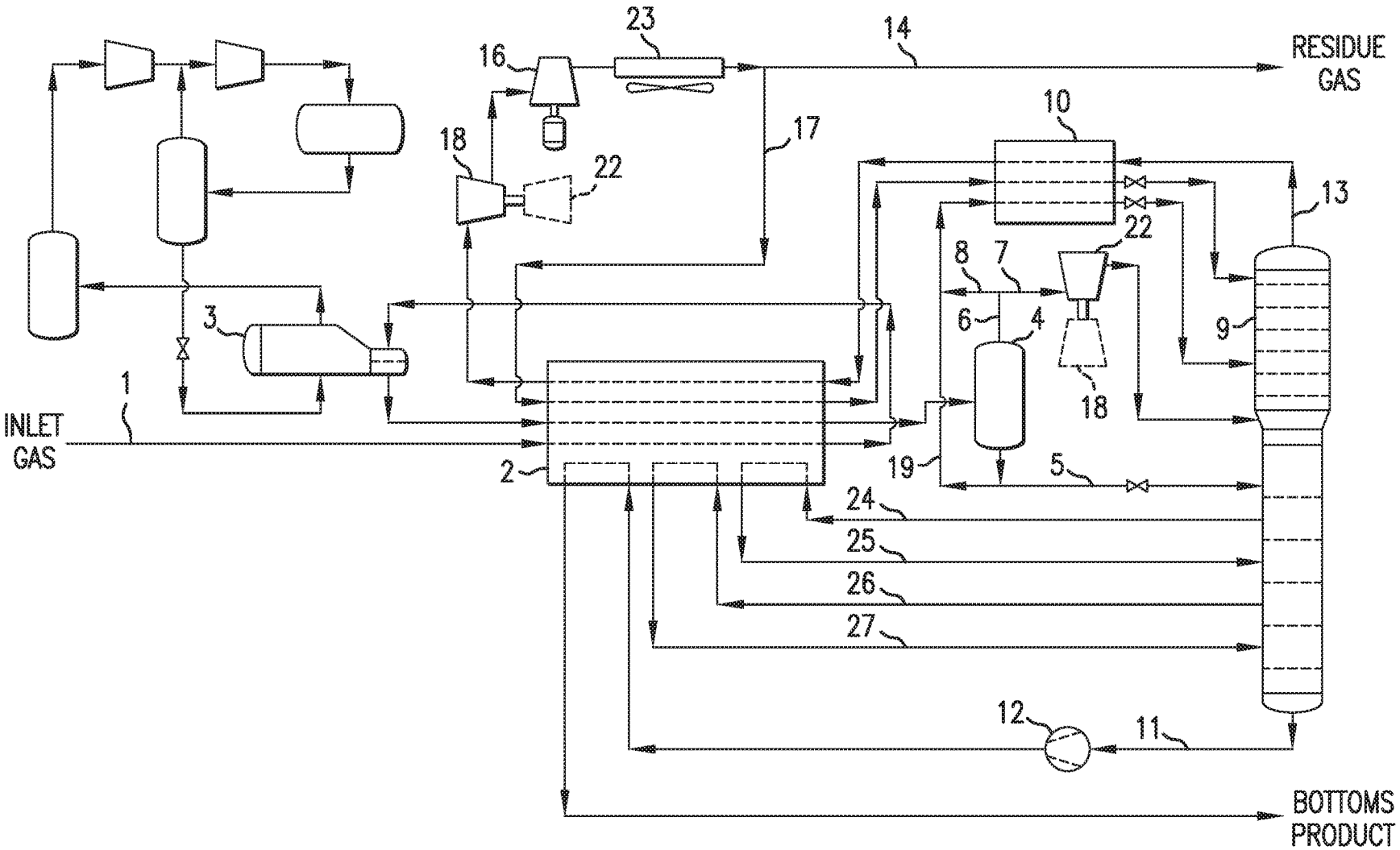
FIG. 1 (PRIOR ART)
FIG. 1 is a schematic representation of a typical natural gas liquids recovery plant.

The present invention provides for the addition of an expansion unit such as a turbo-expander within a natural gas liquids recovery process or plant to allow for high pressure product gas (residue gas) to be used as a refrigerant to provide the necessary refrigeration to either of these operations.

The additional turbo-expander takes the high-pressure residue gas which is a methane-enriched or methane- and ethane-enriched gas from the discharge of the product pipeline recompression equipment (residue gas compression unit) and expands, for example, in a turbo-expander, the gas down to a pressure of between, for example, 100 and 300 psig. The resultant cold refrigerant gas then passes through the overhead heat exchanger and the main heat exchanger(s) and then preferably utilizes the energy from the expansion of the residue gas to boost the pressure of the resultant heated refrigerant gas back to the inlet of the product pipeline recompression equipment.

The advantages of this invention are several fold. First, elimination of an external refrigeration unit (such as a closed loop propane refrigeration system) can increase process efficiency over other NGL plant configurations such as GSP, RSV, and CryoPlus. The total horse power for the plant (residue and refrigerant) required for operation is on the order of 5 to 20 vol. % less than such other NGL plant configurations that utilize an external refrigeration system such as a closed loop propane refrigeration system.

The higher efficiency is due in part to ability to use equipment with higher efficiencies. Refrigeration loop compressors (generally oil-flooded screw compressors) are usually 65-75% efficient whereas the residue gas compressors are generally 80-85% efficient and can go as high as 90% efficient. An expander, such as the expander used to expand a portion of the residue gas which is then employed as refrigerant, is around ~85% efficient and a compressor coupled to such an expander is ~75% efficient.

Additionally, the heat exchange in the main heat exchanger(s) is more efficient because the maximum temperature difference between the cooling and heating curves is low. The maximum temperature difference between the cooling and heating curves of the residue gas exchanged with the feed gas can be as low as 15° F. Conversely, for a heat exchange between a propane refrigerant and a feed gas the maximum temperature difference between the cooling and heating curves of the refrigerant exchanged with the feed gas is usually around 40° F. or higher.

In the process, according to the invention, utilizing only residue gas compression as the source of both residue gas product compression and refrigerant compression offers an added amount of flexibility with regards to plant operation over existing technology. The operating company can either use the residue compression to compress more residue gas product to be fed out of the plant to be sold, or can instead recycle more of the high-pressure residue gas as the refrigerant to increase the level of cooling in the plant and thus, achieve a higher recovery level of NGL products.

The process/plant, according to the invention, also permits the main heat exchanger(s), typically brazed aluminum heat exchanger(s), to operate under lower thermal stress. At any given point within an exchanger, the difference in the temperature between the hot fluid(s) and cold fluid(s) can cause thermal stresses within the exchanger. Long duration or short duration thermal stress can affect the exchanger life, with lower stresses extending the life of the equipment. The maximum allowable difference in temperature is typically 50° F. based on exchanger manufacturer constraints and most processes, such as the process shown in FIG. 1, are performance limited by this constraint in operation and design due in part to the use of a closed loop propane refrigeration system. Since propane boils at one temperature (typically −20 to −30° F.) at a given pressure and the plant feed gas condenses over a range of temperatures (typically 100 to −50° F.), the use of propane as a refrigerant is limited in a single exchanger because the thermal stresses can become high due to the high temperature difference between the fluids.

These lower temperature differences permitted by the inventive process/plant will increase the life of the brazed aluminum heat exchangers as they will be less prone to failure due to temperature stress fractures and cracking.

Another advantage of the process/plant according to the invention is the elimination of contamination of the refrigerant with lube oil. Generally, oil-flooded screw compressors are used in typical propane refrigeration systems. This means the refrigerant is in intimate contact with the compressor lube oil and thus the refrigerant carries some lube oil out of the compressor and into the heat exchanger equipment. The entrained lube oil can lead to fouling issues in the exchanger equipment and/or loss of heat transfer area and ultimately loss of performance. With the elimination of the closed loop propane refrigeration unit, the issues associated with lube oil in the refrigerant system are also eliminated. This also reduces the required maintenance knowledge for the operator as the only compression used is residue compression, as opposed to residue compression and refrigerant compression.

In addition, since the process/plant, according to the invention, does not require an external refrigeration system, there is a substantial savings in terms of the required footprint (plot space) for the plant. Instead of the external refrigeration system, the plant refrigeration system can operate with a single additional turbo-expander for expanding the portion of the residue gas substream that is to be used for cooling and preferably an after cooler (e.g., an air-cooler) downstream of the residue gas compression unit for cooling the compressed residue gas.

A further advantage is that, since the process/plant, according to the invention, does not require an external refrigeration system, there is no need to store or buy process refrigerant.

In one embodiment of the process and apparatus according to the invention the separation or distillation column operates as a demethanizer separating the feed stream into an overhead gaseous stream enriched in methane and lower boiling components and a bottom liquid stream enriched in ethane and higher boiling components. In another embodiment of the process and apparatus according to the invention the separation or distillation column operates as a deethanizer separating the feed stream into an overhead gaseous stream enriched in methane, ethane and lower boiling components and a bottom liquid stream enriched in propane and higher boiling components.

The separation or distillation column contains one or more contact or separation stages such as trays and/or packing to provide the necessary contact and enhance mass transfer between the rising vapor stream and the downward flowing liquid stream. Such trays and packings are well known in the art.

According to one embodiment of the invention, the liquid fraction from the cold gas/liquid separator is expanded via an expansion valve and then introduced into a lower region of the separation or distillation column. According to another embodiment of the invention, the liquid fraction from the cold gas/liquid separator is first expanded via an expansion valve and introduced into the main heat exchanger, where it acts as a cooling medium, before being introduced into a lower region of the separation or distillation column.

According to another embodiment of the invention, the liquid fraction from the cold gas/liquid separator is split into two substreams. One of the substreams is expanded via an expansion valve and then introduced into a lower region of the separation or distillation column. The other substream is combined with the first portion of the gaseous fraction from the cold gas/liquid separator. The resultant combined stream is cooled in the overhead heat exchanger by heat exchange with the overhead gaseous stream removed from the top of the separation or distillation column. The combined stream is then expanded via an expansion valve and introducing into the upper region of the separation or distillation column.

In one embodiment of the invention, a portion of the compressed residue gas is sent directly to a turbo-expander and the resultant expanded residue gas portion is used as a cooling medium in the overhead heat exchanger and then in the main heat exchanger before being compressed and combined with the overhead gaseous stream removed from the top of separation or distillation column. In a further embodiment the portion of the compressed residue gas is first cooled in the main heat exchanger and then is sent to a turbo-expander. In each of these embodiments the resultant expanded residue gas portion is used as a cooling medium in the overhead heat exchanger and then in the main heat exchanger before being compressed and combined with the overhead gaseous stream removed from the top of separation or distillation column.

In a further embodiment, a further portion of the compressed residue gas is cooled in the main heat exchanger and the overhead heat exchanger, expanded in an expansion valve, and introduced into the upper region of the separation or distillation column as a reflux stream.

FIG. 1 illustrates a typical (RSV Design) plant for cryogenic recovery of natural gas liquids. The feed stream 1 of natural gas, typically pretreated to remove water and optionally $CO_2$ and/or $H_2S$, is introduced into the system at a temperature of, for example, 40 to 120° F. and a pressure of 500 to 1100 psig. The natural gas feed stream is cooled in a main heat exchanger 2 by indirect heat exchange with process streams to a temperature −50 to 40° F., and then is further cooled by in a secondary heat exchanger 3 by indirect heat exchange with a refrigerant (e.g., propane) from a closed loop refrigeration cycle. Thereafter, the cooled natural gas feed stream 1 can then be further cooled in the main heat exchanger 2 and then sent to a cold gas-liquid separator 4 where the cooled and partially condensed feed stream 1 is separated into a liquid fraction 5 and a gaseous fraction 6.

The liquid fraction 5 is introduced into a lower region of a separation or distillation column 9 which is a demethanizer, i.e., separates the feed stream into a gaseous overhead stream containing predominantly methane and a liquid bottom stream containing ethane and heavier components, i.e., the NGL product stream.

Alternatively, column 9 can be a deethanizer separating the feed stream into a gaseous overhead stream containing predominantly methane plus ethane and a liquid bottom stream containing propane and heavier components (NGL product). The operating pressure of column 9 (i.e., the pressure in the upper region) is, for example, 150 to 450 psig.

The gaseous fraction 6 from separator 4 is split into a first gas substream 7 and a second gas substream 8. The first gas substream 7 is expanded to a pressure of, for example, 150 to 450 psig, and then introduced into the separation or distillation column 9 at a midpoint, thereof. The second gas substream 8 is cooled by indirect heat exchange in an overhead heat exchanger 10 to a temperature of −160 to −75° F., expanded via an expansion valve, and then introduced into an upper region of separation or distillation column 9 (demethanizer or deethanizer) as a reflux stream.

Optionally, before the liquid fraction 5 is introduced into a lower region of a column 9, a substream 19 of the liquid fraction is branched off and combined with the second gas substream 8 and then the combined stream is cooled by indirect heat exchange in the overhead heat exchanger 10, expanded via an expansion valve, and introduced into an upper region of separation or distillation column 9.

To generate a rising vapor stream within the separation or distillation column 9, a reboiler stream 24 is removed from the lower region of column 9 and used as a cooling heat exchange medium in main heat exchanger 2. The resultant heated stream 25 is returned to the lower region of column 9 at a point below where stream 24 is removed. Additionally, a further reboiler stream 26 can be removed from the lower region of column 9, at a point below the point where stream 25 is returned to the lower region and used as a further cooling heat exchange medium in main heat exchanger 2. The resultant heated stream 27 is returned to the lower region of column 9 at a point below where stream 26 is removed.

A liquid product stream 11 of NGL (C2+ product or C3+ product) is removed from the bottom of column 9. The pressure of the liquid product stream is increased to, for example, 300 to 700 psig, by NGL booster pump 12. The elevated pressure liquid product stream 11 is then used as a cooling medium in main heat exchanger 2 before being removed from the system at, for example, a temperature of 40 to 115° F. and a pressure of 300 to 700 psig.

The overhead gaseous stream 13 is removed from the top of separation or distillation column 9 at a pressure of 150 to 450 psig and a temperature of, for example, −165 to −70° F. and is heated by indirect heat exchange in overhead heat exchanger 10 and then further heated by indirect heat exchange in main heat exchanger 2.

This overhead gaseous stream 13 is characterized as a residue gas and contains a significant amount of methane. If column 9 is a deethanizer, this stream will also contain an appreciable amount of ethane. After being used as a cooling medium in overhead heat exchanger 10 and main heat exchanger 2, overhead gaseous stream 13 is subjected to compression in one or more compressors 18, 16 (or one or more multistage compressors), cooled in an after cooler 23 (e.g., an air-cooler) and then discharged from the system as a compressed residue gas stream 14 at, for example, a temperature of 60 to 120° F. and a pressure of 900 to 1440 psig. A substream 17 is branched off from residue gas stream 14, cooled in main heat exchanger 2, and further cooled in overhead heat exchanger 10 before being returned to the upper region of column 9 as a reflux stream.

Figure 2:
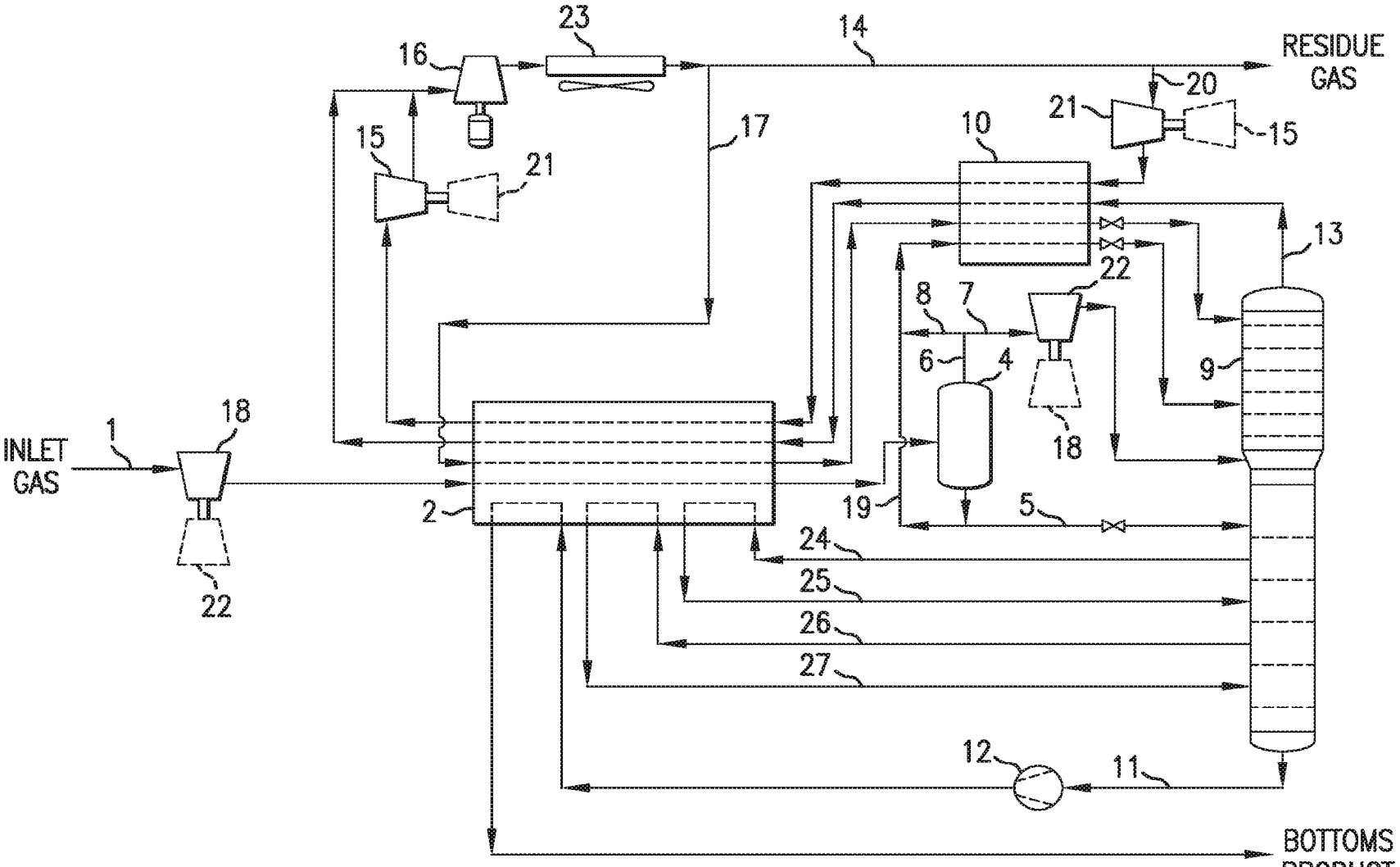
FIG. 2 is a schematic representation of a natural gas liquids recovery plant according to the invention for recovery of ethane and heavier components.

Turning then to FIG. 2, this figure represents a schematic diagram of a natural gas liquids recovery plant according to the present invention. Unlike the plant shown in FIG. 1, this embodiment does not have a secondary heat exchanger 3 wherein the feed stream is cooled by indirect heat exchange with a refrigerant from a closed loop refrigeration cycle. Instead, this embodiment uses a portion of the residue gas generated from the gaseous overhead stream 13 removed from the top of column 9 to provide cooling, as discussed further below.

The natural gas feed stream 1, pretreated to remove water, $CO_2$ and/or $H_2S$, contains, for example, 45 to 95 vol. % C1, 3 to 25 vol. % C2, 2 to 20 vol. % C3, 0.5 to 7 vol. % C4, 0.1 to 8 vol. % C5, and 0 to 5 vol. % C6 and heavier hydrocarbons. As a specific example, the dry feed gas has a composition of 2.4 vol. % nitrogen, 71.0 vol. % C1 (methane), 13.7 vol. % C2 (ethane), 8.1 vol. % C3 (propane), 0.9 vol. % iC4 (isobutane, 2.3 vol. % nC4 (normal butane), 0.3 vol. % iC5 (isopentane), 0.5 vol. % nC5 (normal pentane) and 0.6 vol. % C6 (hexanes) and heavier hydrocarbons, and has a pressure of 500 to 1100 psig and a temperature of 40° to 120° F. The dry feed gas stream 1 is compressed in feed compressor 18 to a pressure of 700 to 1400 psig, preferably 900 to 1250 psig, and then introduced into main heat exchanger 2 (which is typically formed from one or more brazed aluminum heat exchangers) where it is cooled (and partially condensed) to a temperature of −10 to 20° F., preferably 0 to 10° F. The resultant cooled partially condensed feed gas is then fed to a cold gas/liquid separator 4.

In cold gas/liquid separator 4 the cooled and partially condensed feed gas is separated into liquid fraction 5 and gaseous fraction 6. The liquid fraction 5 is expanded through an expansion valve to a pressure of, for example, 150 to 450 psig, preferably 200 to 330 psig and to a temperature of, for example, −10 to −50° F., preferably −15 to −30° F. before being introduced into a lower region of separation or distillation column 9. Stream 5 is introduced at a point below the point which the column diameter increases and also above the lowest liquid/vapor contact means in the column. In this embodiment, column 9 operates as a demethanizer.

The gaseous fraction 6 from separator 4 is split into first gas substream 7 and second gas substream 8. First gas substream 7 is expanded in a turbo-expander 22 to a pressure of, for example, 150 to 450 psig, preferably 200 to 330 psig, which reduces the temperature of the substream to a temperature of, for example, −30 to −110° F., preferably −60 to −90° F. Substream 7 is then introduced into column 9 at a midpoint thereof (i.e., at a point above the introduction point of stream 5). The second gas substream 8 is cooled by indirect heat exchange in overhead heat exchanger 10 to a temperature of, for example, −65 to −150° F., preferably −80 to −145° F. at high pressure. Substream 8 is then expanded through an expansion valve to a pressure of, for example, 150 to 450 psig, preferably 200 to 330 psig and to a temperature of, for example, −110 to −150° F., preferably −120 to −145° F. before being introduced into an upper region of column 9 as a reflux stream. Preferably, the turbo-expander 22 is coupled to feed compressor 18. The operating pressure of column 9 (i.e., the pressure in the upper region) is, for example, 200 to 330 psig.

In general, the operating pressures and temperatures for column 9 are lower when the column functions as a demethanizer in comparison to when the column functions as a deethanizer. For example, the operating pressure of the demethanizer column is preferably between 200 and 330 psig, and the operating pressure of the deethanizer column is preferably between 300 to 450 psig, depending on the composition of the gas and separation level.

Before liquid fraction 5 is introduced into column 9, a substream 19 of the liquid fraction is optionally branched off and combined with the second gas substream 8. The combined stream is then cooled by indirect heat exchange in the overhead heat exchanger 10 before being expanded and introduced into an upper region of column 9.

To generate a rising vapor stream within the separation or distillation column 9, reboiler stream 24 can be removed from the lower region of column 9 at a temperature of, for example, −10 to 20° F., preferably 0 to 10° F., and used as a cooling heat exchange medium in main heat exchanger 2. The resultant heated stream 25 is returned to the lower region of column 9 at a point below where stream 24 is removed. Additionally, a further reboiler stream 26 can be removed from the lower region of column 9, at a point below the point where stream 25 is returned to the lower region and at a temperature of 25 to 50° F., preferably 30 to 40° F., and used as a further cooling heat exchange medium in main heat exchanger 2. The resultant heated stream 27 is returned to the lower region of column 9 at a point below where stream 26 is removed.

Liquid product stream 11 of NGL (C2+ product) is removed from the bottom of column 9. This stream is an ethane-enriched stream having a higher concentration of ethane than that of the feed stream 1. The pressure of stream 11 is increased by NGL booster pump 12 to a pressure of, for example, 300 to 700 psig, preferably 600 to 650 psig. The elevated pressure liquid product stream 11 is then used as a cooling medium in main heat exchanger 2 before being removed from the system at, for example, a temperature of 40 to 115° F. and a pressure of 300 to 700 psig (if desired, this pressure can be further increased to a pipeline pressure of 400 to 1400 psig using additional pumps). The NGL liquid product stream (C2+ product) has a composition of, for example, 0 to 2 vol. % C1, 30 to 60 vol. % C2, 20 to 40 vol. % C3, 5 to 15 vol. % C4, 1 to 5 vol. % C5, and 1 to 5 vol. % C6 and heavier hydrocarbons. For example, the NGL product stream can contain 0.8 vol. % C1, 50.5 vol. % C2, 30.5 vol. % C3, 3.4 vol. % iC4, 8.9 vol. % nC4, 1.7 vol. % iC5, 1.9 vol. % nC5 and 2.3 vol. % C6 and heavier hydrocarbons.

Overhead gaseous stream 13 is removed from the top of separation column 9 at a pressure of, for example, 150 to 450 psig, preferably 200 to 330 psig, and a temperature of, for example, −80 to −170° F., preferably −100 to −165° F. This stream is a methane-enriched stream having a higher concentration of methane than that of the feed stream 1. Overhead gaseous stream 13 is then heated by indirect heat exchange in overhead heat exchanger 10 to temperature of, for example, −20 to 10° F., preferably −5 to 5° F., and then further heated by indirect heat exchange in main heat exchanger 2 to a temperature of, for example, 90 to 115° F., preferably 105 to 110° F. This residue gas stream 13 is then fed to a residue gas compression unit 16 containing one or more compressors, where it is compressed to a pressure of, for example, 900 to 1440 psig, preferably 1000 to 1200 psig. The compressed residue gas is then cooled in an after cooler 23 (e.g., an air cooler), and recovered as a residue sales gas having a composition of, for example, 90 to 99 vol. % C1 and 0.5 to 15 vol. % C2. For example, the residue sales gas has a composition of 3.3 vol. % nitrogen, 96.2 vol. % C1 and 0.5 vol. % C2, a pressure of 900 to 1440 psig, and a temperature of 60° to 120° F.

After compression in residue gas compression unit 16, a first substream 17 is branched off from the compressed residue gas stream 14 and cooled in main heat exchanger 2 to a temperature of, for example, 10 to 30° F., preferably 15 to 25° F. Substream 17 is then further cooled in overhead heat exchanger 10 to a temperature of, for example, −145 to −165° F., preferably −155 to −160° F. Substream 17 is then expanded through an expansion valve to a pressure, for example, 150 to 450 psig, preferably 200 to 330 psig and to a temperature −150 to −170° F., preferably −155 to −165° F. before being fed to the upper region of column 9 as a reflux stream.

To provide further cooling, after compression in residue gas compression unit 16 (and after cooler 23), a second substream 20 of the compressed residue gas stream 14 is expanded in a turbo-expander 21 (or perhaps two or more small expanders) to a pressure of, for example, 100 to 300 psig, preferably 140 to 200 psig, and a temperature of, for example, −65 to −100° F., preferably −75 to −95° F. Substream 20 is then used as a cooling medium, first in overhead heat exchanger 10 and then in main heat exchanger 2, before being compressed in compressor 15 to a pressure of, for example, 250 to 400 psig, preferably 300 to 380 psig. The resultant compressed substream 20, after preferably being cooled in an after cooler (not shown) is then combined with the residue gas stream 13 removed from the top of column 9, and then the combined stream is sent to residue compression unit 16. Preferably, the turbo-expander 21 is coupled to compressor 15.

In a modification of the embodiment of FIG. 2 (not shown in the Figure), a heat exchanger can be used (e.g., a shell and tube heat exchanger) to provide heat exchange between the residue gas discharged from compressor 15 (before it is introduced into residue gas compression unit 16) and the expanded residue gas portion discharged from expander 21 (before it is introduced into the overhead heat exchanger 10). This modification (which can also be made in the embodiments of FIGS. 3 and 4) allows for greater flexibility with regards to adjusting the duty of the refrigerant.

Figure 3:
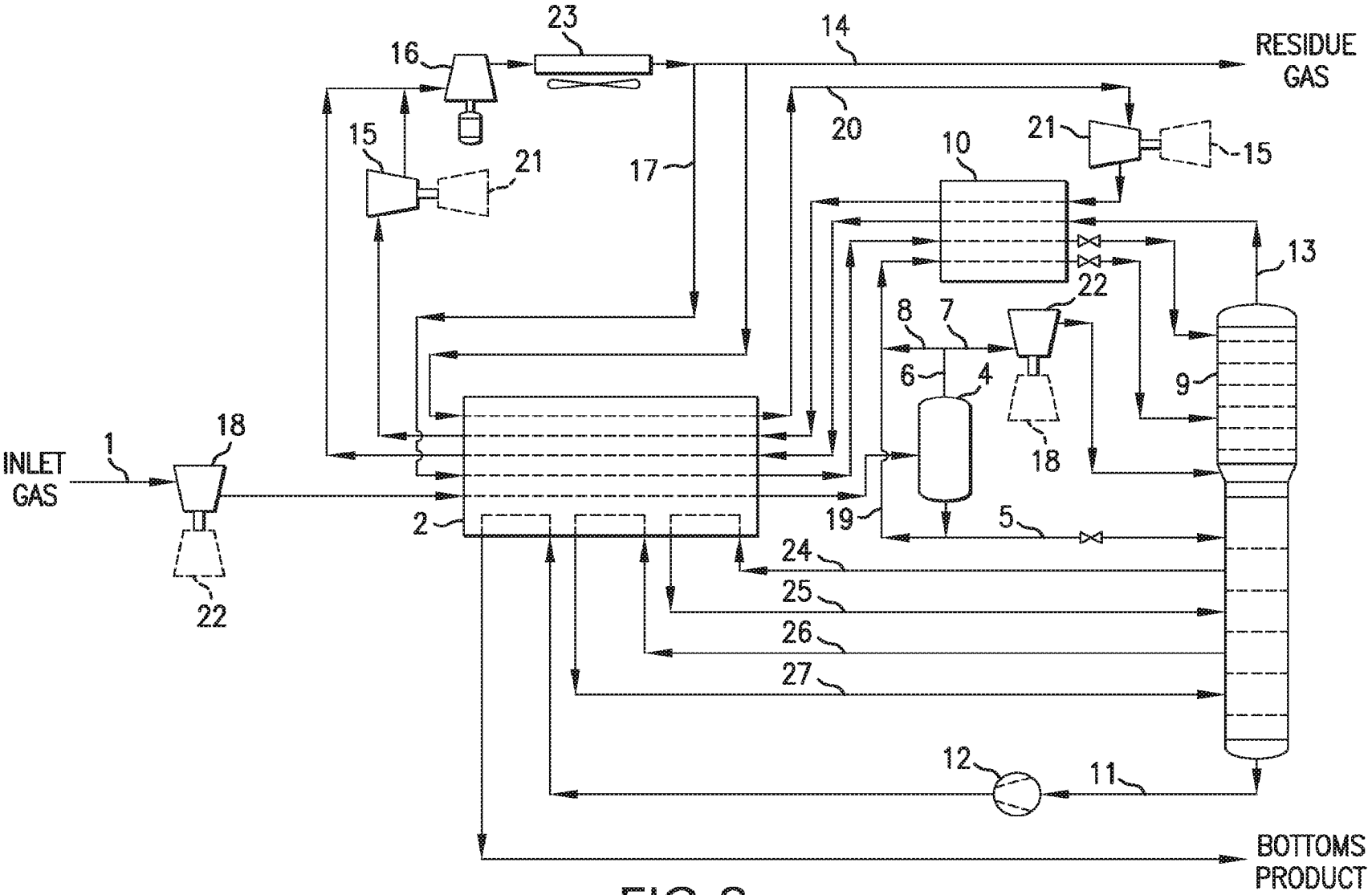
FIG. 3 is a schematic representation of an alternative natural gas liquids recovery plant according to the invention for recovery of ethane, propane and heavier components.

FIG. 3 is a schematic representation of a further embodiment of a natural gas liquids recovery plant according to the invention. This embodiment is similar to the embodiment of FIG. 2. The embodiment of FIG. 3 differs from that of FIG. 2 with regards to the generation and handling of the second substream 20 of the compressed residue gas 14. In this embodiment, column 9 operates as a demethanizer. The operating pressure of column 9 (i.e., the pressure in the upper region) is, for example, 150 to 450 psig, preferably 200 to 330 psig.

In FIG. 3, after compression in residue gas compression unit 16 and cooling in after cooler 23, the second substream 20 of the compressed residue gas stream 14 is branched off and cooled in the main heat exchanger 2. Second substream 20, before being expanded in turbo-expander 21, is used as a heating medium in main heat exchanger 2 where it is cooled to a temperature of, for example, −20 to 40° F., preferably to 5 to 20° F. Second substream 20 is then expanded in turbo-expander 21 (or perhaps two or more small expanders) to a pressure of, for example, 100 to 300 psig, preferably 140 to 200 psig and a temperature of, for example, −130 to −170° F., preferably −150 to −165° F., and then used as a cooling medium, first in overhead heat exchanger 10 and then in main heat exchanger 2. Substream 20 is then compressed in compressor 15, cooled in an after cooler (not shown; e.g., an air-cooler) combined with the residue gas stream 13 removed from the top of column 9, and then the combined stream is sent to residue compression unit 16. Here again, turbo-expander 21 is preferably coupled to compressor 15.

Figure 4:
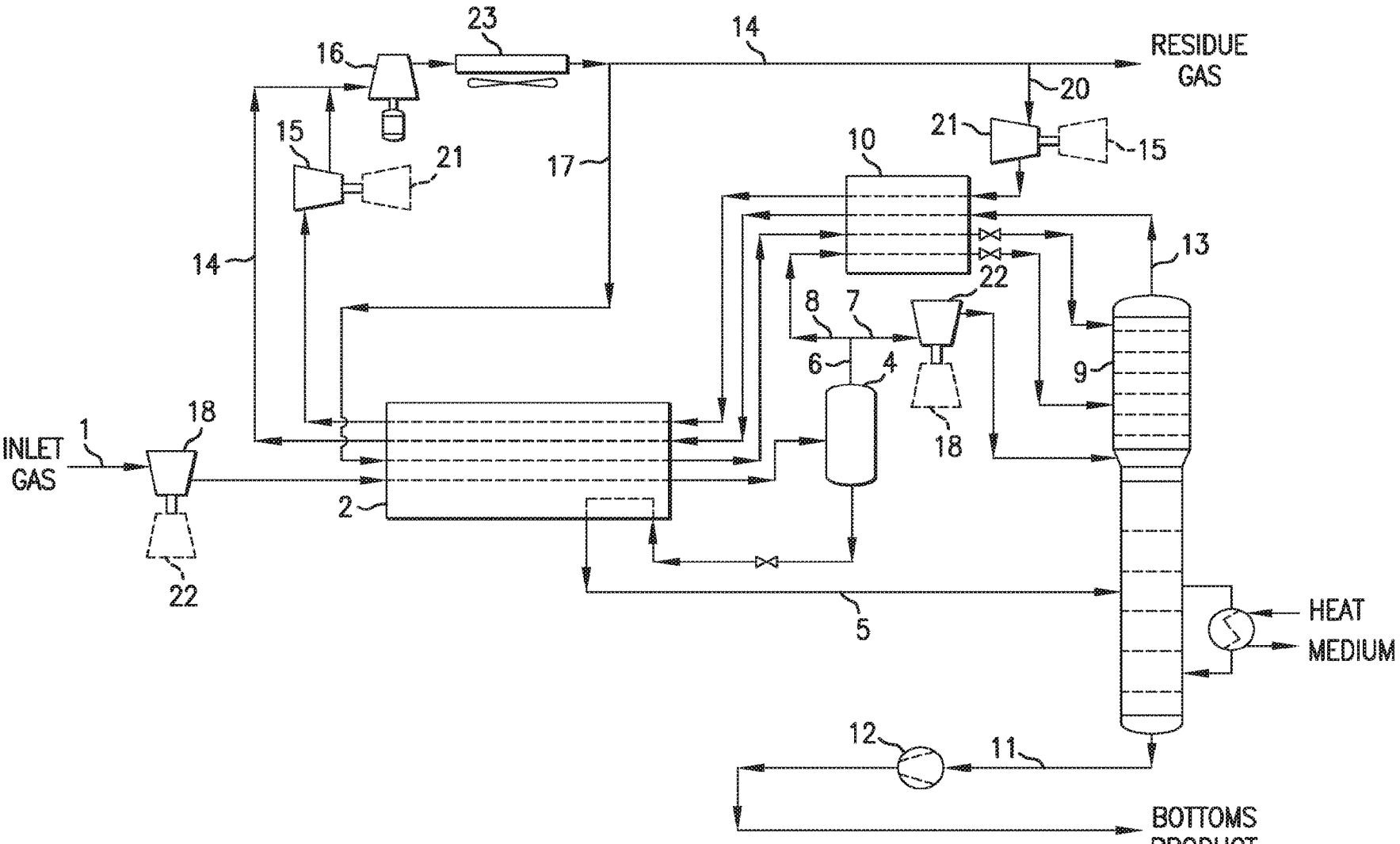
FIG. 4 is a schematic representation of an alternative natural gas liquids recovery plant according to the invention for recovery of propane and heavier components.

FIG. 4 is a schematic representation of a further embodiment of a natural gas liquids recovery plant according to the invention. This embodiment is similar to the embodiment of FIG. 2. However, in the embodiment of FIG. 4 the separation or distillation column 9 is a deethanizer and the handling of the liquid fraction 5 from cold gas/liquid separator 4 and the heating of the column 9 differs from that of FIG. 2. The operating pressure of column 9 (i.e., the pressure in the upper region) is, for example, 150 to 450 psig, preferably 300 to 400 psig. The liquid product stream 11 of NGL removed from the bottom of column 9 is a C3+ liquid stream. This stream is a propane-enriched stream having a higher concentration of propane than that of the feed stream 1. The gaseous overhead stream 13 removed from the top of separation column 9 is a C2− stream. This stream is a methane-enriched and ethane-enriched stream having higher concentration of methane and ethane than that of the feed stream 1.

In FIG. 4, liquid fraction 5 is first expanded via an expansion valve to a pressure of, for example, 150 to 400 psig preferably 300 to 400 psig. Liquid fraction 5 is then heated in the main heat exchanger 2 to a temperature of, for example, 60 to 120° F., preferably 90 to 115° F., before being introduced into the lower region of column 9. In addition, the embodiment of FIG. 4 does not use reboiler streams 24-27 to generate the rising vapor stream within the separation or distillation column 9. Instead, a liquid stream is removed from the bottom region of column 9, heated in a reboiler heat exchanger by indirect heat exchange with an external heating medium and then returned to the bottom region of column 9.

Figure 5:
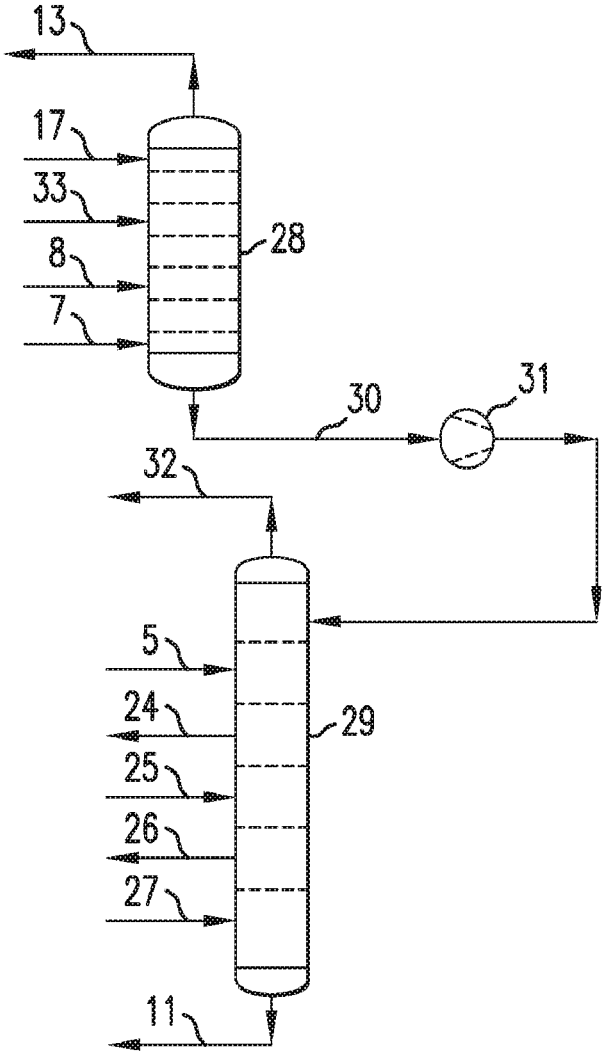
FIG. 5 is a schematic representation of a modification of the NGL recovery plant according to the invention wherein a single column of the distillation system is replaced by two columns.

FIG. 5 illustrates a modification that can be applied to each of the embodiments of FIGS. 2-4. In this modification the single demethanizer or deethanizer column is replaced by two columns, a light ends fraction column (LEFC) and a heavy ends fractionation column (HEFC).

The first gas substream 7 from separator 4 is expanded in a turbo-expander 22 to a pressure of, for example, 150 to 450 psig, preferably 200 to 330 psig, which reduces the temperature of the substream to a temperature of, for example, −30 to −110° F., preferably −60 to −90° F. substream 7 is then introduced into the bottom region of column 28, i.e., the LEFC.

The second gas substream 8 from separator 4, after being cooled by indirect heat exchange in overhead heat exchanger 10 to a temperature of, for example, −65 to −150° F., preferably −80 to −145° F., is expanded through an expansion valve to a pressure of, for example, 150 to 450 psig, preferably 200 to 330 psig and to a temperature of, for example, −110 to −150° F., preferably −120 to −145° F. Second gas substream 8 is then introduced into column 28 at a midpoint thereof. As in the embodiments of FIGS. 2-4, optionally, a substream 19 of the liquid fraction 5 is combined with the second gas substream 8 and before the combined stream is cooled in the overhead heat exchanger 10.

First substream 17 from the compressed residue gas stream 14 is cooled in main heat exchanger 2 to a temperature of, for example, 10 to 30° F., preferably 15 to 25° F. Substream 17 is then further cooled in overhead heat exchanger 10 to a temperature of, for example, −145 to −165° F., preferably −155 to −160° F. Substream 17 is then expanded through an expansion valve to a pressure, for example, 150 to 450 psig, preferably 200 to 330 psig and to a temperature −150 to −170° F., preferably −155 to −165° F. before being fed to the upper region of column 28 as a reflux stream.

A bottom liquid stream 30 is removed from the bottom of column 28, optionally pressurized in pump 31, and then introduced into the top region of column 29, i.e., the HEFC. Liquid fraction 5 from separator 4 is introduced into an upper region of column 29, at a point below the introduction of bottom liquid stream 30.

Additionally, an overhead stream 32 taken from column 29 is sent to overhead heat exchanger 10 where it is cooled and partially condensed. The resulting stream 33 is then sent to column 28 where it is introduced below stream 17 but above stream 8.

Reboiler stream 24 is removed from column 29, at a point below the introduction point of liquid fraction 5 and used as a cooling heat exchange medium in main heat exchanger 2. The resultant heated stream 25 is returned to column 29 at a point below where stream 24 is removed. Additionally, a further reboiler stream 26 can be removed from the lower region of column 29, at a point below the point where stream 25 is returned to the column 29 and used as a further cooling heat exchange medium in main heat exchanger 2. The resultant heated stream 27 is returned to the lower region of column 29 at a point below where stream 26 is removed.

The columns 28 and 29 (i.e., the LEFC and HEFC) can in combination acts as a demethanizer or a deethanizer. Thus, when the two columns are acting as a demethanizer, overhead gaseous stream 13 is removed from the top of column 28 at a pressure of, for example, 150 to 450 psig, preferably 200 to 330 psig, and a temperature of, for example, −80 to −170° F., preferably −100 to −165° F. This stream is a methane-enriched stream having a higher concentration of methane than that of the feed stream 1. Liquid product stream 11 of NGL (C2+ product) is removed from the bottom of column 29. This stream is an ethane-enriched stream having a higher concentration of ethane than that of the feed stream 1.

When the two columns are acting as a deethanizer, overhead gaseous stream 13 removed from the top of column 28 is a C2− stream. This stream is a methane-enriched and ethane-enriched stream having higher concentration of methane and ethane than that of the feed stream 1. The liquid product stream 11 of NGL removed from the bottom of column 29 is a C3+ liquid stream. This stream is a propane-enriched stream having a higher concentration of propane than that of the feed stream 1.

The preceding examples can be repeated with similar success by substituting the generically or specifically described compositions and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein are incorporated by reference herein.

The invention claimed is:

1. A process for natural gas liquids (NGL) recovery comprising:

introducing a natural gas feed stream into a main heat exchanger wherein the feed stream is cooled and partially condensed, introducing the partially condensed feed stream into a cold gas/liquid separator wherein the partially condensed feed stream is separated into a liquid fraction and a gaseous fraction, introducing the liquid fraction into a separation or distillation column, separating the gaseous fraction into a first portion and a second portion, cooling the first portion of the gaseous fraction in an overhead heat exchanger by indirect heat exchange with an overhead gaseous stream removed from the top of the separation or distillation column, and introducing the cooled and partially condensed first portion of the gaseous fraction into the separation or distillation column at a point above the introduction point of the liquid fraction into the separation or distillation column, expanding the second portion of the gaseous fraction and introducing the expanded second portion of the gaseous fraction into the separation or distillation column at a point above the introduction point of the liquid fraction into the separation or distillation column, removing a C2+ or C3+ liquid product stream (NGL) from the bottom of the separation or distillation column, removing the overhead gaseous stream from the top of the separation or distillation column, the overhead gaseous stream being enriched with methane, using the overhead gaseous stream as a cooling medium in the overhead heat exchanger and then in the main heat exchanger, compressing the overhead gaseous stream in a residue gas compression unit to obtain a pressurized residue gas stream, expanding a portion of the pressurized residue gas stream and using the expanded residue gas as a cooling medium in the overhead heat exchanger and in the main heat exchanger, and compressing the expanded residue gas used as a cooling medium to form a compressed residue gas stream and then combining the compressed residue gas stream with the overhead gaseous stream upstream of the residue gas compression unit.

2. The process according to claim 1, wherein the separation or distillation column is a demethanizer.

3. The process according to claim 1, wherein the separation or distillation column is a deethanizer.

4. The process according to any one of claim 1, wherein the gas feed stream is compressed by a feed compressor prior to being introduced into said main heat exchanger.

5. The process according to claim 4, wherein expansion of the second portion of the gaseous fraction is performed in a turbo-expanded which is coupled to said feed compressor.

6. The process according to claim 1, wherein cooled first portion of the gas fraction is expanded via an expansion valve before being introduced into the separation or distillation column.

7. The process according to claim 1, wherein the liquid fraction from the cold gas/liquid separator is expanded via an expansion valve before being introduced into a lower region of the separation or distillation column.

8. The process according to claim 1, wherein the liquid fraction from the cold gas/liquid separator is split into a first liquid substream and a second liquid substream, the first liquid substream is expanded via an expansion valve and then introduced into a lower region of the separation or distillation column, and the second liquid substream is combined with the first portion of the gaseous fraction from the cold gas/liquid separator and the resultant combined stream is cooled in the overhead heat exchanger by heat exchange with the overhead gaseous stream removed from the top of the separation or distillation column.

9. The process according to claim 8, wherein said combined stream is expanded via an expansion valve and before being introduced into an upper region of the separation or distillation column.

10. The process according to claim 1, wherein said portion of the compressed residue gas that is to he expanded is sent directly to a turbo-expander for expansion and the resultant expanded residue gas portion is then used as a cooling medium in the overhead heat exchanger and in the main heat exchanger.

11. The process according to claim 1, wherein said portion of the compressed residue gas that is to he expanded is first cooled in the main heat exchanger and then is sent to a turbo-expander for expansion.

12. The process according to claim 1, wherein a further portion of the compressed residue gas is cooled in the main heat exchanger and the overhead heat exchanger, expanded in an expansion valve, and introduced into the upper region of the separation or distillation column as a reflux stream.

13. The process according to claim 1, wherein the separation or distillation column is a deethanizer and said liquid fraction from said cold gas/liquid separator is first expanded via an expansion valve then introduced into said main heat exchanger as a cooling medium, and then and introduced into a lower region of the separation or distillation column.

14. A process for natural gas liquids (NGL) recovery comprising:

introducing a natural gas feed stream into a main heat exchanger(s) wherein the feed stream is cooled and partially condensed, introducing the partially condensed feed stream into a cold gas/liquid separator wherein the partially condensed feed stream is separated into a liquid fraction and a gaseous fraction, introducing the liquid fraction into a separation or distillation column system, separating the gaseous fraction into a first portion and a second portion, cooling the first portion of the gaseous fraction in an overhead heat exchanger by indirect heat exchange with an overhead gaseous stream removed from the top of the separation or distillation column system, and introducing the cooled and partially condensed first portion of the gaseous fraction into the separation or distillation column system, expanding the second portion of the gaseous fraction and introducing the expanded second portion of the gaseous fraction into the separation or distillation column at, removing a C2+ or C3+ liquid product stream (NGL) from the bottom of the separation or distillation column system, removing the overhead gaseous stream from the top of the separation or distillation column system, the overhead gaseous stream being enriched with methane, using the overhead gaseous stream as a cooling medium in the overhead heat exchanger and in the main heat exchanger(s), compressing the overhead gaseous stream in a residue gas compression unit to obtain a pressurized residue gas stream, expanding a portion of the pressurized residue gas stream and using the expanded residue gas as a cooling medium in the overhead heat exchanger and in the main heat exchanger(s), and compressing the expanded residue gas used as a cooling medium to form a compressed residue gas stream and then combining the compressed residue gas stream with the overhead gaseous stream upstream of the residue gas compression unit.

15. The process according to claim 14, wherein the separation or distillation column system contains one column that acts as a demethanizer column or a deethanizer column.

16. The process according to claim 14, wherein the separation or distillation column system contains two columns that together act as a demethanizer column or a deethanizer column.

* * * * *